United States Patent [19]

Benton

[11] Patent Number: 4,895,071

[45] Date of Patent: Jan. 23, 1990

[54] UNITARY DOCTOR BLADE ASSEMBLY

[75] Inventor: Robert R. C. Benton, Princeton Junction, N.J.

[73] Assignee: Benton Graphics, Inc., Trenton, N.J.

[21] Appl. No.: 63,639

[22] Filed: Jun. 17, 1987

Related U.S. Application Data

[63] Continuation-in-part of Ser. No. 851,165, Apr. 14, 1986, abandoned.

[51] Int. Cl.[4] ..... B41F 9/10; B41F 31/04

[52] U.S. Cl. ..... 101/169; 15/256.5; 118/261

[58] Field of Search ..... 101/169, 170, 157, 364, 101/365; 15/256.5, 256.51; 118/261

[56] References Cited

U.S. PATENT DOCUMENTS 2,498,213 2/1950 Ljungquist ..... 15/256.51
3,855,927 12/1974 Simeth ..... 101/169 X
3,866,266 2/1975 Dunlap ..... 101/169 X
4,184,429 1/1980 Widmer ..... 101/169

FOREIGN PATENT DOCUMENTS 121060 9/1980 Japan ..... 101/169
61-01853 8/1981 Japan ..... 101/169

*Primary Examiner*—Edgar S. Burr
*Assistant Examiner*—Moshe L. Cohen
*Attorney, Agent, or Firm*—Cobrin, Feingertz & Godsberg

[57] ABSTRACT

A doctor blade assembly consisting of a first section and a second section. The first section acts as a backup for the second section. The second section includes a leading portion, which is of a reduced thickness and has a bevel to wipe excess ink from a gravure cylinder. The first and second sections are adhered to each other. The second section can be notched to alleviate the deleterious effects of camber.

17 Claims, 2 Drawing Sheets

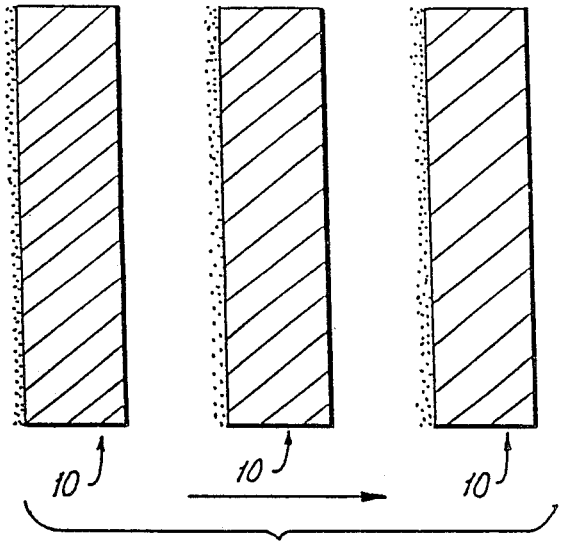
FIG. 1
FIG. 2
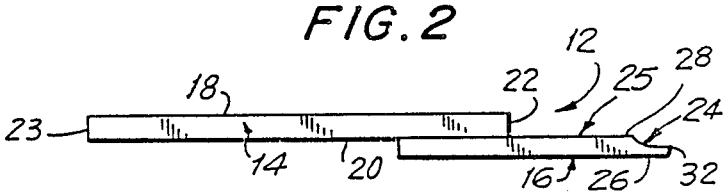
FIG. 4
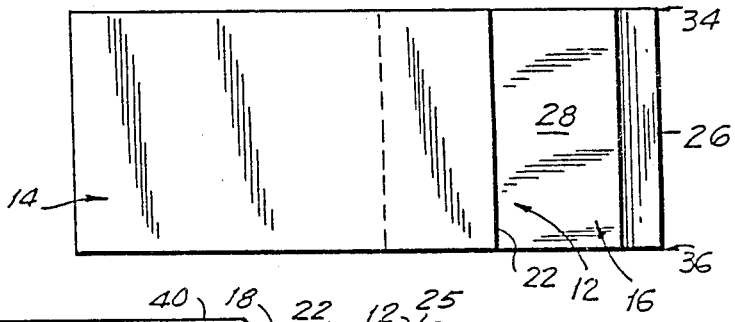
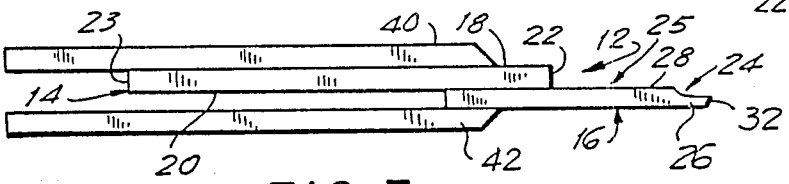
FIG. 3

UNITARY DOCTOR BLADE ASSEMBLY

CROSS-REFERENCE TO RELATED APPLICATION

This application is a continuation-in-part of my copending application Ser. No. 851,165 filed Apr. 14, 1986 for UNITARY DOCTOR BLADE ASSEMBLY, now abandoned.

BACKGROUND OF THE INVENTION

This invention relates generally to the field of gravure printing and specifically to an improved doctor blade.

Photogravure or gravure printing is a technique whereby intaglio engravings of an image which is to be printed on a substrate (usually paper) are formed by known techniques on the surface of a gravure cylinder. Intaglio engravings are those where the elements to be printed are below the surface of the gravure cylinder, having been cut or etched into the metallic cylinder to form ink-retaining grooves or cups.

It has long been recognized that a very important factor in producing high quality gravure printing is the proper design and use of a doctor blade.

A doctor blade is a long, thin strip of metal which is mounted on a gravure printing machine parallel to the axis of the printing cylinder, with the thin edge of the strip very close to the surface of the gravure cylinder. When the cylinder is in operation, the doctor blade controls the amount of ink transferred from the printing surface of the cylinder to the paper or other impression-receiving material by wiping of the surplus ink.

Examples of doctor blades illustrated in the prior art are as follows:

| |
|---|
| U.S. Pat. No. 1,092,798 |
| U.S. Pat. No. 1,760,049 |
| U.S. Pat. No. 2,230,583 |
| U.S. Pat. No. 2,313,830 |
| U.S. Pat. No. 2,361,554 |
| U.S. Pat. No. 2,655,561 |
| U.S. Pat. No. 3,040,442 |
| U.S. Pat. No. 3,122,767 |
| U.S. Pat. No. 3,521,561 |
| U.S. Pat. No. 3,649,991 |
| U.S. Pat. No. 3,720,163 |
| U.S. Pat. No. 3,866,266 |
| U.S. Pat. No. 3,884,145 |
| U.S. Pat. No. 4,151,797 |
| U.S. Pat. No. 4,184,429 |
| Canadian Patent No. 986,783 |
| Canadian Patent No. 991,477 |
| Dutch Patent No. 7,312,922 |
| W. German Patent No. 2,305,120 |
| W. German Gebrauchmuster 1,976,227 |
| Japanese Patent No. 5,121,060 |
| Japanese Patent No. 6,101,853 |

"Doctor Blade Problems," by Heinz Sander, 1966 Rotogravure Yearbook, Gesellschaft zur Forderung des Tiefdrucks e.V., Wiesbaden, Germany.

Throughout the long history of gravure printing, it has been recognized that, while there are many factors affecting the quality of gravure printing, one of the most important, if not the most important, is the proper design and usage of the doctor blade. Specifically, even if a gravure cylinder has been properly etched and cut, improper doctor blade design and usage will prevent the obtaining of a proper image.

It is highly desirable that there be uniform pressure over the width of the doctor blade against the gravure cylinder in the printing areas so that there is a clean, even wipe with resulting even print quality. It is also desirable that there be uniform pressure across the width of the doctor blade because with uneven pressure across the width of the doctor blade there is uneven doctor blade and cylinder wear, with the greatest wear occurring where the doctor blade is stiffest. The uneven doctor blade pressure discussed herein is a problem in the prior art and one which the present invention is, inter alia, aimed at solving.

A further problem with prior art doctor blades results from doctor blade camber—i.e., the convexity of the working edge of the doctor blade. Camber results in the doctor blade wearing unevenly, with concomitant uneven wear at the center of the gravure cylinder which the doctor blade is wiping. Camber has heretofore been a problem with prior art doctor blades. However, it should be noted that the camber at the end of the doctor blade is beneficial in that it reduces the force applied to the doctor blade, and hence wear, where it is only partially supported by the cylinder.

A further problem with prior art doctor blades has been bleeding. Bleeding may be defined as the depositing of an ink film or ink particles on non-depressed areas of a gravure cylinder adjacent the cut-out or etched areas of the gravure cylinder. The result is a spillover on the printed substrate such that adjacent the trailing edge of a solid printed section where there is intended to be a non-printed section ink particles appear. This, of course, is highly undesirable and lowers print quality.

A further problem with prior art doctor blades is end wear. More specifically, this problem arises from two principal causes. One of the causes is that the edges of the doctor blade overlay the cylinder and do not receive adequate lubrication and support. Another cause is the lateral oscillation that is inherent in the operation of a doctor blade. Obviously end wear is undesirable in that it adversely affects doctor blade life.

A further problem associated with many prior art doctor blades was the presence of dry or liquid ink particles between the backup blade and the doctor blade. This resulted in the backup blade not uniformly supporting the doctor blade during doctoring operations, causing the spring constant of the doctor blade assembly to vary, which, of course, is undesirable.

Uniform pressure against the entire printing cylinder by the doctor blade is not desirable in that uniform pressure is desirable only against those portions of the printing cylinder which do the printing. At the end portions of the doctor blade, where printing does not occur, it is desirable to relieve pressure. Sometimes in the prior art the backup blade was cut back to relieve pressure at the end of the printing cylinder.

While I have discussed herein technical factors affecting print quality and doctor blade and cylinder life, the economics of running a gravure printing press operation must, of course, be considered. Gravure press equipment is universally recognized as being expensive. In addition, the labor costs associated with running a gravure press are also significant. This is because gravure pressmen are highly skilled and as a consequence thereof are highly paid. Thus, it can readily be seen that anytime a gravure press is not operating during a period when it is supposed to be producing printed substrate (downtime) there are significant costs associated with this downtime. In addition, downtime may result in failure to meet printing deadlines.

A frequent cause of press downtime is the need to replace worn doctor blades. A doctor blade generally has a certain useful life that will vary with press conditions, which useful life is measured in revolutions of the gravure cylinder. Thus, a particular doctor blade for a particular set of press conditions may have a working life of 200,000 revolutions of the gravure cylinder, etc. When a doctor blade needs to be replaced, then the press must be stopped, resulting in the expensive press machinery being inoperative. Naturally, the prior art has made efforts to extend doctor blade life.

Another factor that must be weighed in the economic analysis of a pressroom operation is the cost of a doctor blade. Heretofore, doctor blades were made in their entirety of doctor blade steel. Doctor blade steel is relatively expensive and any reduction in the amount of doctor blade steel in a doctor blade will affect pressroom economics.

OBJECTS AND SUMMARY OF THE INVENTION

It is an object of the present invention to provide an improved doctor blade for use in gravure printing operations.

More specifically, it is an object of the present invention to provide an improved doctor blade that is capable of providing high quality printing on a gravure press.

A further object of the present invention is to provide an improved doctor blade that is designed such that, to the extent possible, there is uniform pressure in the print areas of the gravure cylinder over the width of the doctor blade.

Yet a further object of the present invention is to provide an improved doctor blade that minimizes the deleterious effects of uneven doctor blade pressure in the print areas of the gravure cylinder over the width of the doctor blade.

Another object of the present invention is to provide an improved doctor blade that minimizes the deleterious effects of camber, while not eliminating the beneficial effects of camber.

Still another object of the present invention is to provide an improved doctor blade that minimizes uneven doctor blade wear and cylinder wear due to doctor blade camber.

A further object of the present invention is to provide an improved doctor blade that reduces the deleterious effects of bleeding.

Yet another object of the present invention is to provide an improved doctor blade that reduces end wear.

A further object of the present invention is to provide a doctor blade that minimizes the deleterious effects of doctor blade oscillation along the width thereof.

A still further object of the present invention is to provide an improved doctor blade that has a good working life.

A further object of the present invention is to provide an improved doctor blade that minimizes press downtime.

Another object of the present invention is to provide an improved doctor blade that minimizes the press downtime by reason of the frequent need to change doctor blades.

A further object of the present invention is to provide a doctor blade that is economical in cost.

Yet another object of the present invention is to provide an improved doctor blade that is made from a metal that is significantly less expensive than conventional doctor blade steel, the doctor blade in such configuration that the metal effectively perform the required doctoring operation while providing improved resistance to the deleterious effects of camber.

Other objects of the present invention will become apparent to those of ordinary skill in the art.

In accordance with one aspect of the present invention, the foregoing and other objects are achieved by a multipartite, one-piece doctor blade assembly that is formed of two attached sections. The first section includes a first surface that is substantially flat. The second section includes a leading portion as well as a trailing portion. The second section leading portion is of significantly reduced cross-section when compared to the cross-section of the trailing portion. More specifically, the leading portion includes means to wipe the excess ink from the surface of a gravure cylinder. The second section includes a first surface with a portion of the first section first surface in contact with a portion of the second section first surface. Means are provided for physically adhering the portions of the first section first surface and the second section first surface to each other to form a rigid one-piece doctor blade assembly which can be inserted into and used in a gravure press.

In another aspect of the present invention, the first section first surface is substantially flat, as is the second section first surface.

In still a further aspect of the present invention, the second section leading portion wiping means includes a bevel, said second section leading portion increasing in height going along its length away from the bevel.

Alternatively, the second section leading portion remains substantially constant in height going along its length away from the bevel.

Also according to the present invention, the first section should be springy and preferably have a coating that is resistant to atmospheric and handling corrosion, while the second section is composed of doctor blade steel.

The present invention also provides for the adhering means to be an adhesive, with one type of adhesive that can be used being "Loctite" adhesive.

While the present invention in one aspect contemplates the second section being composed of doctor blade steel, the first surface of the second section is desirably dechromed to facilitate the adherence of the two sections to each other.

In addition, the present invention provides for the deoxidization of the contacting surfaces.

In another aspect of the present invention, the ends of the doctor blade are pre-stressed so as to minimize end wear and the problems associated therewith.

In yet another aspect of the present invention, a doctor blade assembly is formed of two attached sections. The first (backup) section includes a first surface that is substantially flat. The second section is not made of expensive doctor blade steel but is made of a cold worked steel with a carbon content of about 0.75% and higher and a tensile strength in excess of about 280,000 psi. One such steel is BARTEX steel manufactured by Wallace Barnes Steel Co. Unexpectedly, the top and bottom surfaces of the doctor blade are harder than the interior which leads to the significant advantage of sharper wiping action on the gravure cylinder. This type of steel sells in the vicinity of $3/lb., which is significantly lower that the cost of doctor blade steel heretofore used. The second section includes a leading portion as well as a trailing portion. The leading portion includes forward section which is of significantly reduced cross-section when compared to the cross-section of the trailing portion and defines a bevel.

In order to assist in minimizing the effects of camber, the trailing portion of the second section may include a series of spaced apart notches. The notches are simply cutouts in the second section and, because they are spaced apart, the notches are separated from each other by solid portions of the second section. It has been determined that by using notching as just described the deleterious effects of camber are significantly reduced.

The above, and other objects, features and advantages of the present invention, will become readily apparent from the following detailed description thereof which is to be read in conjunction with the accompanying drawings.

BRIEF DESCRIPTION OF THE DRAWINGS

FIG. 1 is an illustration that is intended to depict bleeding;

FIG. 2 is a side plan view of a unitary doctor blade structure according to the present invention;

FIG. 3 is a plan view of a unitary doctor blade assembly according to the present invention;

FIG. 4 is a top plan view of a unitary doctor blade structure according to the present invention;

DESCRIPTION OF THE PREFERRED EMBODIMENT

Figure 5:
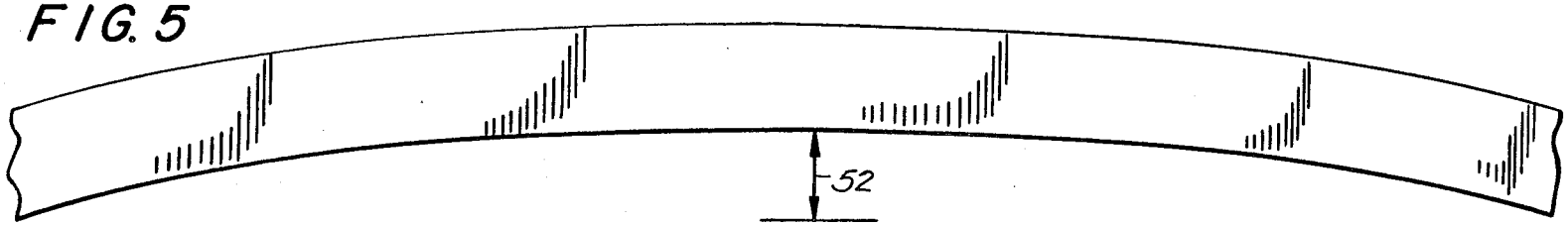
FIG. 5 is a top plan view showing camber in a doctor blade.

In FIG. 1 of the drawings, several printed bars are illustrated by reference numeral 10 and are depicted in cross-hatching to show that they have been printed by means of a gravure press. The arrow below the reference numerals 10 indicates the direction of the gravure cylinder as it passes over the substrate. For purposes of terminology, the right edge of each bar as shown in FIG. 1 is referred to as a "leading" edge and the left edge of each bar shown in FIG. 1 as a "trailing" edge. The dots which are adjacent the trailing edge of each bar 10 in FIG. 1 are intended to illustrate bleeding—i.e., the unintended depositing of ink particles along the trailing edge of a solid printed section. Obviously bleeding is undesirable and, as was discussed previously herein, a problem with prior art doctor blades. Although it is not totally understood, there are certain hypotheses as to the cause of bleeding.

In FIG. 5 of the drawings a doctor blade 50 is shown, with the dimension 52 illustrating how camber is measured. As may be recalled, camber is the convexity of the leading edge of a doctor blade. As previously noted, camber is a serious problem which adversely affects the wear of a doctor blade and the economics of a gravure press operation.

In FIG. 2 of the drawings a unitary doctor blade assembly 12 according to the present invention is disclosed. Doctor blade 12 includes two sections—i.e., backup section 14 and doctoring section 16. Backup section 14 should be springy and preferably have a coating that is resistant to atmospheric and handling corrosion. Examples of materials that are suitable for the backup section are TFS (tin-free steel) and more specifically, TFS-DR8, which by its specification has a thin chromium coating for corrosion protection. Alternatively, tin can stock can be used. Tin can stock sells at a relatively modest price (30¢/lb.) when compared to the cost of doctor blade steel, which is approximately $9.00/lb. It should be noted that TFS is more desirable than tin can stock since it is more resistant to atmospheric and handling corrosion than tin can stock. Doctoring section 16 is composed of doctor blade steel and is adhered to backup section 14, as will hereinafter be described. Backup section 14 generally includes an upper surface 18, a lower parallel opposed surface 20, a front edge 22 and a rear edge 23. Edges 22 and 23 are parallel to each other as well as being perpendicular to surfaces 18 and 20. The width of backup section 14 is generally greater than the width of the gravure cylinder which the unitary doctor blade assembly 12 is intended to wipe and the specific amount of the excess width of backup section 14 per se does not form a part of the present invention but can be selected in accordance with known principles.

Doctoring section 16, which, as noted previously, is made of doctor blade steel, includes a leading potion 24 and a trailing portion 25. Leading portion 24 includes a reduced thickness section 26. Alternatively, the leading portion need not be of a reduced thickness but may have the configuration of the Benton B blade. It should be noted that trailing portion 25 includes an upper surface 28 and a lower surface 30. In referring to section 26 as having a reduced thickness, this refers to the height of the section relative to the distance between the surfaces 28 and 30. The cross-section of section 26 can be such that the upper and lower surfaces thereof are parallel to each other, which is known in the prior art, as exemplified by U.S. Pat. No. 4,184,429. Alternatively, the upper surface of section 26 can have a slight upward taper such as is known in the art and is exemplified by doctor blades heretofore manufactured and sold by Benton Graphics and which are identified as the Benton A blade. It is possible that other cross-sections of reduced thickness section 26 may be used incorporating the principles of the present invention.

The width of doctoring section 16 is generally equal to and/or greater than the width of backup section 14. A bevel 32 is formed on the forward tip of doctoring section 16 and, as is known in the art, serves to wipe excess ink from the gravure cylinder. The particular angle of attack of bevel 32 does not form a part of the present invention and can be selected in accordance with known printing techniques.

Surface 28 of doctoring section 16 is in contact with a portion of surface 20 of backup section 18. Normally, the uncovered longitudinal dimension of surface 28 of doctoring section 16 can be in the range of 0.050" to 0.375". However, this range is set forth for illustration purposes only and not by way of limitation and can be varied as desired.

Means are provided for adhering doctor blade section 16 to backup section 14 so that a unitary one-piece doctor blade assembly is obtained. While a specific technique is set forth herein, it will be obvious to those skilled in the art that other possible techniques of adhering a portion of surface 20 to a portion of surface 28 are available.

TFS material includes a thin chromium coating and in order to improve the adhesion of the portion of the surface which contacts the doctor blade section, the adhering surface of the backup section is mechanically or chemically dechromed. This can be done by using a flexible abrasive material. If tin can stock is used, there is no need for a dechroming process. In addition, the contacting portions of surfaces 20 and 28 are chemically deoxidized inasmuch as this affects the bonding time. It should be noted, however, that the dechroming step is essential for TFS material since without it the desired adhesion will not be obtained.

After the dechroming and deoxidizing steps are affected, an adhesive is utilized to adhere the overlapping portions of surfaces 20 and 28 to each other. One such adhesive that is suitable for this purpose is Loctite adhesive identified by the trademark DEPEND.

In FIG. 4 of the drawings a desirable means is illustrated for minimizing the deleterious effects of end wear. To accomplish this goal, the reduced thickness edges of bevel 32 are pre-stressed in the direction shown by arrows 34 and 36, which has the desired effect of reducing end wear, as will hereinafter be described. The pre-stressing of the edges of bevel 32 can be achieved by rigidly securing doctoring section 16 before the adhesion step and applying a force in the general vicinity of arrows 34 and 36 until the doctor blade steel has been worked so that there is a pre-stressing. In use, doctor blade assembly 12, according to the present invention, will be inserted between jaws 40 and 42 of a doctor blade clamp (FIG. 3) and fed into close proximity to a gravure cylinder during a printing operation.

By bonding sections 14 and 16 together, as just described, liquid ink or dired ink cannot get between the sections and change the spring constant of the doctor blade assembly. The resulting doctor blade assembly is bonded in such a manner that the flexor strength and spring constant are not altered by the presence of the material being doctored (removed) either in the liquid, semi-solid or solid state.

The doctor blade just described provides uniform pressure over its width against the gravure cylinder so there is a clean, even wipe with resulting even print quality. The resulting uniform pressure prevents uneven wear of the doctor blade and uneven wear of the cylinder.

As noted previously, certain problems with prior art doctor blades resulted from camber, which is defined as the convexity of the working edge of the doctor blade. Camber resulted in the doctor blade wearing unevenly at the central portion of the gravure cylinder, with uneven wear at the center of the gravure cylinder. Because of the design of the doctor blade assembly of the present invention, the effects of camber are minimized.

A further problem that has been discussed herein is that of bleeding. Running of the doctor blade of the present invention tremendously minimizes the deleterious effects of bleeding. The reason for this is not known, but any reduction in bleeding greatly enhances print quality.

By pre-stressing the edges of doctor blade bevel 32, as shown in FIG. 4, the deleterious effects of end wear are minimized. This has been observed in use with a doctor blade assembly according to the present invention.

All of the foregoing advantages of the doctor blade assembly of FIGS. 2–4 enhance printing quality and/or the economics of the gravure press operation. A further enhancement of the economics of the gravure press operation by a doctor blade assembly according to FIGS. 2–4 is that tests have shown that the doctor blade assembly of the present invention has a longer working life than many prior art doctor blades. This results in less downtime and more efficient press operation.

Finally, by having the backup section 14 made of relatively low-cost tin can stock, while only doctoring section 16 is made of high-cost doctor blade steel, the overall cost of the doctor blade assembly is minimized.

Figure 6:
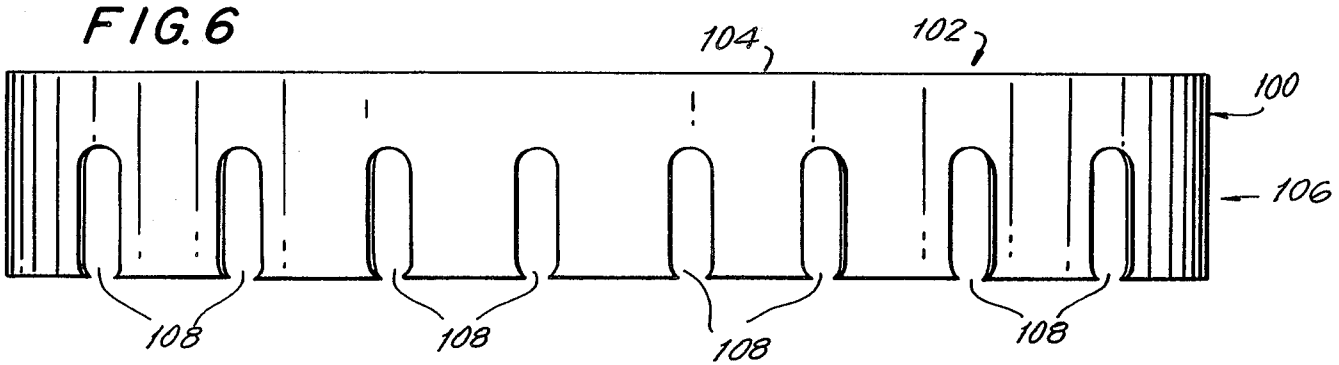
FIG. 6 is top plan view of an alternate embodiment of the present invention.

In FIG. 6 of the drawings an alternate doctor blade structure 100 is shown which includes a backup section not illustrated as heretofore described and a doctoring section 102. Doctoring section 102 includes a forward edge 104. Forward edge 104 is a bevel that performs the wiping action on the gravure cylinder and can be of reduced thickness relative to the rear section 106 of doctoring section 102. Specifically, the forward portion of doctoring section 102 can have the configuration shown for doctoring section 16 illustrated in FIG. 2 or an other configuration that one might elect.

Located in rear section 106 of doctoring section 102 are a series of identical notches 108. These notches are sections of doctoring section 102 along the rear portion thereof that are removed by conventional metal removal techniques—e.g., stamping. The effect of removing and forming notches on the rear section 106 is that this cold works certain portions of the rear part of the doctor blade enhancing the strength and doctoring characteristics. This is achieved because the notching which is formed by cold working induces stresses in the doctor blade so that the effects of camber are drastically minimized. The notching shown in FIG. 6 consists generally of elliptical shaped notches.

One aspect of utilizing notches is that while doctor blade steel generally runs in the range of from approximately \$8/lb. to \$11/lb., by using a notched structure, as shown in FIG. 6, an extremely low-cost steel can be used which heretofore had not been thought suitable for doctoring purposes. One such material is BARTEX steel having a carbon content of about 0.82%, a tensile strength of about 347,000 psi, a microstructure of fine Lamelliqe pearlite, a straightness deviation of 0.49 in./10 ft., a flatness of 3–4 piw, a coil set of $30\times t/39$ in. and a surface roughness of $Rt=1,1-1,5$ m.

While the reasons that notching provides the benefits discussed herein are not fully understood, it is believed that by notching selected sections of the doctor blade are narrowed so that the blade can be flexed, which enables accommodation for camber. In addition, the notching cold works edges of the doctor blade where the material is removed from the doctor blade, which results in correcting the effects of camber. Through the use of a variable spacing of the notches, it is possible to totally eliminate camber, even though the camber varies in the original material.

It should be noted that the notching must be performed on the concave side of the strip to correct camber.

The microstructure of the BARTEX steel would appear to be totally unsuitable for doctor blade application and the straightness deviation would likewise appear to be totally unacceptable for a doctor blade. In addition, the flatness deviation could cause residual stresses which would normally adversely affect doctor blade performance. Thus, one would hardly expect that the BARTEX steel would be suitable as doctor blade steel and, in fact, the art teaches away from using this material. Nevertheless, and without any explanation, it has been found that when making a two-piece doctor blade having the doctor blade section made of BARTEX steel and with or without a notch arrangement, a very clean wipe is obtained and the operating life of the doctor blade is significantly greater (on the order of 2.5 times) than that of comparable doctor blades made with conventional doctor blade steel such as Uddeholm 18CR or Eberle 18ER. In addition, camber is essentially eliminated by using the notched structure which likewise increases operating life of the doctor blade.

Adding to the significant advantages heretofore set forth of using a doctor blade structure incorporating BARTEX steel as the doctoring material is the fact that this material can be purchased for about $3/lb., which is significantly less than the cost of conventional steels which are used a doctor blade materials. The manner of attaching doctoring section 102 to the backup section is the same as heretofore set forth in connection with the structure shown in FIG. 2. The spacing between the notches should be selected by empirically determining that which minimizes camber. It should be noted that all of the advantages discussed in connection with using the bonded blade as set forth in FIGS. 2–4 apply to using a bonded blade having BARTEX steel with or without the notching shown in FIG. 6.

With the doctor blade of the present invention, dry or liquid ink particles cannot find their way between the backup blade and the doctor blade. As a consequence thereof, the doctor blade assembly of the present invention has a substantially stable spring constant which provides for improved printing results.

With the doctor blade of the present invention the backup blade can be cut back to relieve end pressure, as was done in the prior art. However, the doctor blade of the present invention has the added advantage of relieving end pressure independently of controlling camber at the middle of the doctor blade, something that was not possible with the prior art.

The notching of the BARTEX that is used in the doctor blade assembly of the present invention has certain advantages, including inducing stresses on one side of the doctor blade to correct camber and making the doctor blade more flexible in a direction necessary to adjust for camber. Notching will not work in conventional doctor blades inasmuch as dry or liquid ink particles will be transported between the doctor blade and the backup blade through the notching such that the spring constant of the doctor blade assembly will vary. However, by using a bonded doctor blade, as set forth herein, the problem of dry or liquid ink particles being transported between the backup blade and the doctor blade is substantially eliminated.

Figure 7:
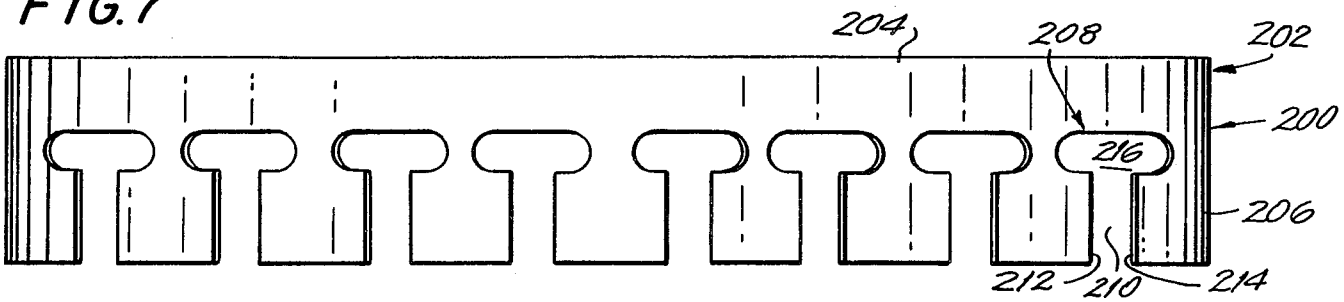
FIG. 7 is top plan view of yet another embodiment of the present invention.

In FIG. 7 of the drawings an alternate doctoring section 200 is shown which includes a forward section 202, a beveled forward edge 204 and a rear section 206. The configuration of forward section 202 can be that shown in FIG. 2 or any other configuration that might be chosen. Notches 208 are formed in doctoring section 200 and are generally mushroom shaped having a base 210, parallel opposed sides 212 and 214, and a generally elliptical shaped upper portion 216. The removal of the material to define notches 216 can be by conventional metal removing techniques (stamping which cold works the edges of the notches inducing stresses that essentially eliminate camber).

All carbon steel doctor blades prior to this invention were manufactured of hardened and tempered carbon steels having a carbon content of about 0.9% to 1.0% carbon and hardened and tempered to an ultimate tensile strength of about 280,000 to 306,000 psi. A second category of steels wherein hardness is obtained by cold working—i.e., cold rolling, for example—and having a carbon content in excess of 0.75% and an ultimate tensile strength of 250,000 psi or higher can be used in the doctor blade assembly of the present invention. It is, of course, to be appreciated that the setting forth of specific doctor blade compositions is for purposes of illustration and not of limitation, as will be apparent to those having ordinary skill in the art. An example of such material is BARTEX steel manufactured by Wallace Barnes Steel Co. which contains 0.78% to 0.82% carbon and has an ultimate tensile strength in the range of 320,000 to 345,000 psi.

As with the notched doctor blade structure shown in FIG. 6, the structure of FIG. 7 is preferably made of BARTEX steel having the characteristics heretofore set forth and essentially eliminates camber and the deleterious effects thereof, while increasing blade life by a significant factor over conventional doctor blades (e.g., by a factor of 2.5:1). In addition, a very clean wipe can be obtained. As with the structure of FIG. 6, by using the BARTEX steel the cost of the raw doctor blade material is dramatically reduced. The distance between the notches and the precise size and shape of the notches can be selected to essentially eliminate camber.

Other advantages of the present invention will be readily apparent to those skilled in the art.

What is claimed is:

1. An apparatus for use in a gravure press for wiping excess ink from the surface of a gravure cylinder, comprising a one-piece doctor blade structure formed of two attached sections, said first section being made from a metallic, non-doctor blade material and including a first surface, said second section being made of doctor blade steel and including a leading portion and a trailing portion, said leading portion being of reduced thickness as compared to the thicknesses of the trailing portion, said leading portion including means for wiping the excess ink from the surface of a gravure cylinder, said second section including a first surface, a portion of said first section first surface in contact with a portion of said second section first surface, and means for setting a predetermined controlled camber in said second section by adhering stressed portions of said second section to said first section to form a rigid one-piece doctor blade assembly which has a flexural strength and spring constant not altered by the presence between said first and second sections of the material being doctored either in liquid, semi-solid or solid state, whereby said rigid one-piece doctor blade assembly can be inserted into and used in a gravure press.

2. An apparatus according to claim 1, wherein said second section leading portion wiping means includes a bevel, said second section leading portion changing in height going along its length away from said bevel.

3. An apparatus according to claim 1, wherein said second section leading portion wiping means includes a bevel, said second section leading portion remaining substantially constant in height going along its length away from said bevel.

4. An apparatus according to claim 1, wherein said first section is TFS.

5. An apparatus according to claim 1, wherein said first section is tin can stock.

6. An apparatus according to claim 1, wherein said second section is composed of hard-rolled steel with a carbon content of about 0.75% and higher.

7. An apparatus according to claim 4, wherein said second section is composed of hard-rolled steel with a carbon content of about 0.75% and higher.

8. An apparatus according to claim 7, wherein said adhering means is Loctite DEPEND adhesive.

9. An apparatus according to claim 4, wherein said second section is made from doctor blade steel, said first section first surface being dechromed.

10. An apparatus according to claim 9, wherein said adhering means is an adhesive.

11. An apparatus according to claim 9, wherein said adhesive is Loctite DEPEND adhesive.

12. An apparatus according to claim 10, in which said first and second section contacting first surfaces are deoxidized.

13. An apparatus for use in a gravure press for wiping excess ink from the surface of a gravure cylinder comprising a one-piece doctor blade structure formed of two attached sections, said first section having a first surface, said second section having a first surface, a portion of each of said first and second section first surfaces being bonded to each other, said second section first surface extending in part past the end of said first section first surface and terminating in a forward doctoring portion and means for minimizing the deleterious effects of camber in said second section including spaced apart cold worked portions in the portion of said second section which is bonded to said first surface of said first section.

14. An apparatus according to claim 13, wherein said spaced apart cold worked portions of said second section are spaced at the rear of said second section.

15. An apparatus according to claim 13, wherein said second section is comprised of BARTEX steel.

16. An apparatus according to claim 13, wherein said means for minimizing the deleterious effects of camber in said second section includes a series of spaced apart notches in the rear of said second section.

17. An apparatus according to claim 13, wherein said means for minimizing the deleterious effects of camber in said second section includes stressed portions of the second section.

* * * * *